US009920614B2

(12) United States Patent
Trinh et al.

(10) Patent No.: US 9,920,614 B2
(45) Date of Patent: Mar. 20, 2018

(54) APPARATUS AND METHOD FOR DRILLING WELLBORES BASED ON MECHANICAL SPECIFIC ENERGY DETERMINED FROM BIT-BASED WEIGHT AND TORQUE SENSORS

(75) Inventors: Tu Tien Trinh, Houston, TX (US); Eric Sullivan, Houston, TX (US); Lane E. Snell, Wheat Ridge, CO (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1146 days.

(21) Appl. No.: 13/454,359

(22) Filed: Apr. 24, 2012

(65) Prior Publication Data

US 2012/0279783 A1 Nov. 8, 2012

Related U.S. Application Data

(60) Provisional application No. 61/483,180, filed on May 6, 2011.

(51) Int. Cl.
*E21B 45/00* (2006.01)

(52) U.S. Cl.
CPC ..... *E21B 45/00* (2013.01)

(58) Field of Classification Search
CPC ..... E21B 44/00; E21B 44/02; E21B 47/024; E21B 49/003; E21B 47/12; E21B 45/00
See application file for complete search history.

(56) References Cited

U.S. PATENT DOCUMENTS 5,163,521 A 11/1992 Pustanyk et al.
2008/0156531 A1 7/2008 Boone et al.
2009/0090555 A1* 4/2009 Boone et al. ..... 175/45
2010/0089648 A1* 4/2010 Hall et al. ..... 175/57
2010/0252325 A1 10/2010 Porche

FOREIGN PATENT DOCUMENTS

WO WO2010027839 A2 3/2010

OTHER PUBLICATIONS

International Search Report and Written Opinion dated Nov. 29, 2012 for International Application No. PCT/US2012/035202.
Pessier, R.C. et al,; "Quantifying Common Drilling Problems With Mechanical Specific Energy and a Bit-Specific Coefficient of Sliding Friction," SPE 24584, 67th Annual Technical Conference and Exhibition of the Society of Petroleum Engineers, Washington, D.C., Oct. 4-7, 1992, pp. 373-388.

* cited by examiner

*Primary Examiner* — Nicole Coy
*Assistant Examiner* — Kristyn A Hall
(74) *Attorney, Agent, or Firm* — Cantor Colburn LLP

(57) ABSTRACT

The disclosure, in one aspect, provides a method of drilling a wellbore that includes features of drilling the wellbore using a drilling assembly that includes a drill bit that further includes a weight sensor and a torque sensor, determining weight-on-bit using measurements from the weight sensor and torque-on-bit using measurement from the torque sensor during drilling of the wellbore, obtaining measurements for rotational speed of the drill bit and rate of penetration of the drill bit during drilling of the wellbore, determining mechanical specific energy of the bottomhole assembly using the determined weight-on-bit, torque-on-bit and obtained rotational speed of the drill bit and the obtained rate of penetration of the drill bit, and altering a drilling a parameter in response to the determined mechanical specific energy.

18 Claims, 5 Drawing Sheets

APPARATUS AND METHOD FOR DRILLING WELLBORES BASED ON MECHANICAL SPECIFIC ENERGY DETERMINED FROM BIT-BASED WEIGHT AND TORQUE SENSORS

CROSS-REFERENCE TO RELATED APPLICATIONS

This application takes priority from U.S. Provisional application Ser. No. 61/483,180, filed on May 6, 2011, which is incorporated herein in its entirety by reference.

BACKGROUND

Field of the Disclosure

This disclosure relates generally to drilling of a wellbore using measurements made by bit-based torque and weight sensors.

Brief Description of the Related Art

Oil wells (wellbores) are drilled with a drill string that includes a tubular member having a drilling assembly (also referred to as the bottomhole assembly or "BHA") with a drill bit attached to the bottom end thereof. The drill bit is rotated to disintegrate the earth formations to drill the wellbore. Weight-on-bit, torque-on-bit, rotational speed of the drill bit and rate of penetration of the drill bit into the formation are monitored and controlled for efficient drilling of the wellbore. Typically, a driller at the surface and/or a controller in the BHA, using surface sensor measurements or measurements made by sensors in the BHA, adjust drilling parameters, such as weight applied from the surface, rotational speed of the drill string, rotation of a drilling motor connected to the drill bit and supply of the drilling fluid from the surface. Often, during drilling of a deviated section of the wellbore, the weight-on-bit and torque-on-bit measured by sensors in the BHA or sensors at the surface are different from the actual weight-on-bit and torque-on-bit measured by sensors in the drill bit (bit-based sensors). It is therefore desirable to utilize weight-on-bit and torque-on-bit measurements obtained from bit-based sensors for efficient drilling and to improve longevity of the drill bit and BHA.

The disclosure herein provides a drilling apparatus and method for drilling wellbores utilizing bit-based sensor measurements of the weight-on-bit and torque-on-bit.

SUMMARY

In one aspect a method of drilling a wellbore is disclosed, which method, in one embodiment, includes: drilling the wellbore using a drill bit on a drilling assembly, which drill bit includes both a weight sensor configured to provide measurements relating to weight-on-bit and a torque sensor configured to provide measurements relating to torque-on-bit during drilling of the wellbore; determining weight-on-bit from measurements from the weight sensor and torque-on-bit using measurements from the torque sensor; determining a mechanical-specific-energy of the drilling assembly during drilling of the wellbore; and altering a drilling parameter based at least in part on the determined mechanical specific energy of the drilling assembly.

In another aspect, the disclosure provides an apparatus for drilling a wellbore that in one embodiment includes: a drilling assembly; a drill bit attached to the drilling assembly, a weight sensor in the drill bit for providing measurements relating to the weight-on-bit during drilling of the wellbore and a torque sensor configured to provide measurements relating to torque-on-bit during drilling of the wellbore; and a processor configured to determine a mechanical-specific-energy of the drilling assembly based at least in part on the weight-on-bit determined from the measurements provided by the weight sensor and torque-on-bit determined from the measurements provided by the torque sensor.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DETAILED DESCRIPTION

Figure 1:
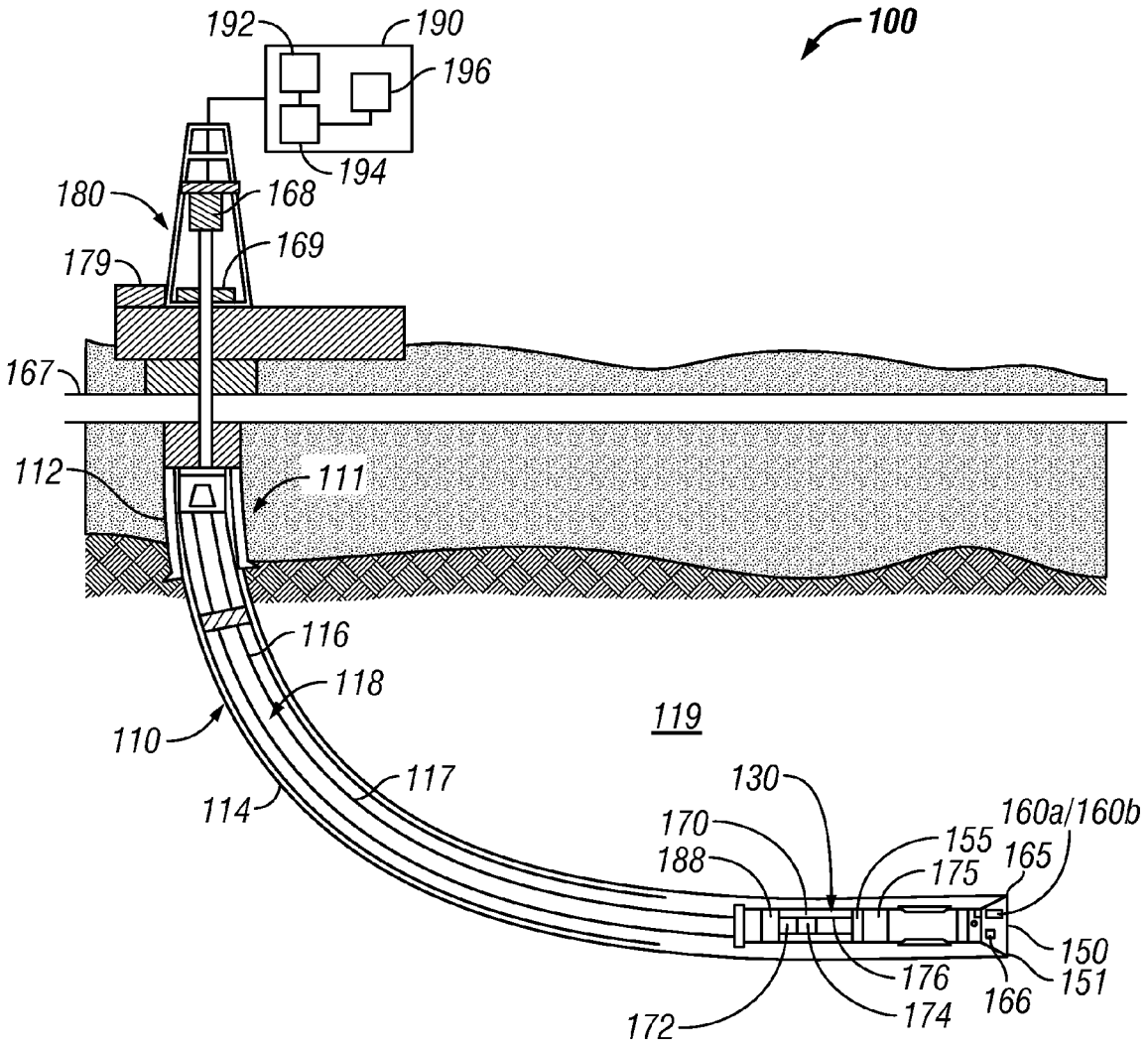
FIG. 1 is a schematic diagram of an exemplary drilling apparatus configured to use a drill bit made according to one embodiment of the disclosure herein.

FIG. 1 is a schematic diagram of an exemplary drilling system 100 that may use drill bits disclosed herein for drilling wellbores. FIG. 1 shows a wellbore 110 that includes an upper section 111 with a casing 112 installed therein and a lower section 114 being drilled with a drill string 118. The drill string 118 includes a tubular member 116 that carries a drilling assembly 130 (also referred to as the bottomhole assembly or "BHA") at its bottom end. The tubular member 116 may be coiled tubing or joined drill pipe sections. A drill bit 150 is attached to the bottom end of the BHA 130 for drilling the wellbore 110 in the formation 119.

The drill string 118 is shown conveyed into the wellbore 110 from an exemplary rig 180 at the surface 167. The exemplary rig 180 shown in FIG. 1 is a land rig for ease of explanation. The apparatus and methods disclosed herein may also be utilized with offshore rigs. A rotary table 169 or a top drive 168 coupled to the drill string 118 may be utilized to rotate the drill string 118 and thus the drilling assembly 130 and the drill bit 150 to drill the wellbore 110. A drilling motor 155 (also referred to as "mud motor") may also be provided to rotate the drill bit 150. A control unit (or controller or surface controller) 190, that may be a computer-based unit, may be placed at the surface 167 for receiving and processing data transmitted by the sensors in the drill bit 150 and other sensors in the drilling assembly 130 and for controlling selected operations of the various devices and sensors in the drilling assembly 130. The surface controller 190, in one embodiment, may include a processor 192, a data storage device (computer-readable medium) 194 for storing data and computer programs 196. The data storage device 194 may be any suitable device, including, but not limited to, a read-only memory (ROM), a random-access memory (RAM), a flash memory, a magnetic tape, a hard disc and an optical disk. To drill wellbore 110, a drilling fluid 179 is pumped under pressure into the tubular member 116. The drilling fluid 179 discharges at the bottom 151 of the drill bit 150 and returns to the surface via the annular space (also referred as the "annulus") 117 between the drill string 118 and the inside wall of the wellbore 110.

Still referring to FIG. 1, the drill bit 150 includes a torque sensor 160*a* to obtain real-time estimates of torque-on-bit during drilling of the wellbore 110 and a weight sensor 106*b* for determining the real-time weight-on-bit during drilling of the wellbore. An electric circuit 165 in the drill bit 150 may be provided for processing signals from the torque and weight sensors. Other sensors, collectively designated by numeral 166, such as sensors for determining rotational speed, vibration, whirl, stick-slip, etc. of the drill bit may also be provided in the drill bit 150. Additionally, drilling assembly 130 may include one or more downhole sensors (also referred to as the measurement-while-drilling (MWD) or logging-while-drilling (LWD) sensors, collectively designated by numeral 175, and a control unit (or controller) 170 for processing data received from the MWD sensors 175 and sensors 160*a*, 160*b* and 166 in the drill bit 150. The controller 170 may include a processor 172, such as a microprocessor, a data storage device 174 and a program 176 for use by the processor 172 to process data downhole and to communicate data with the surface controller 190 via a two-way telemetry unit 188. The data storage device may be any suitable memory device, including, but not limited to, a read-only memory (ROM), random access memory (RAM), flash memory and disk.

Figure 2:
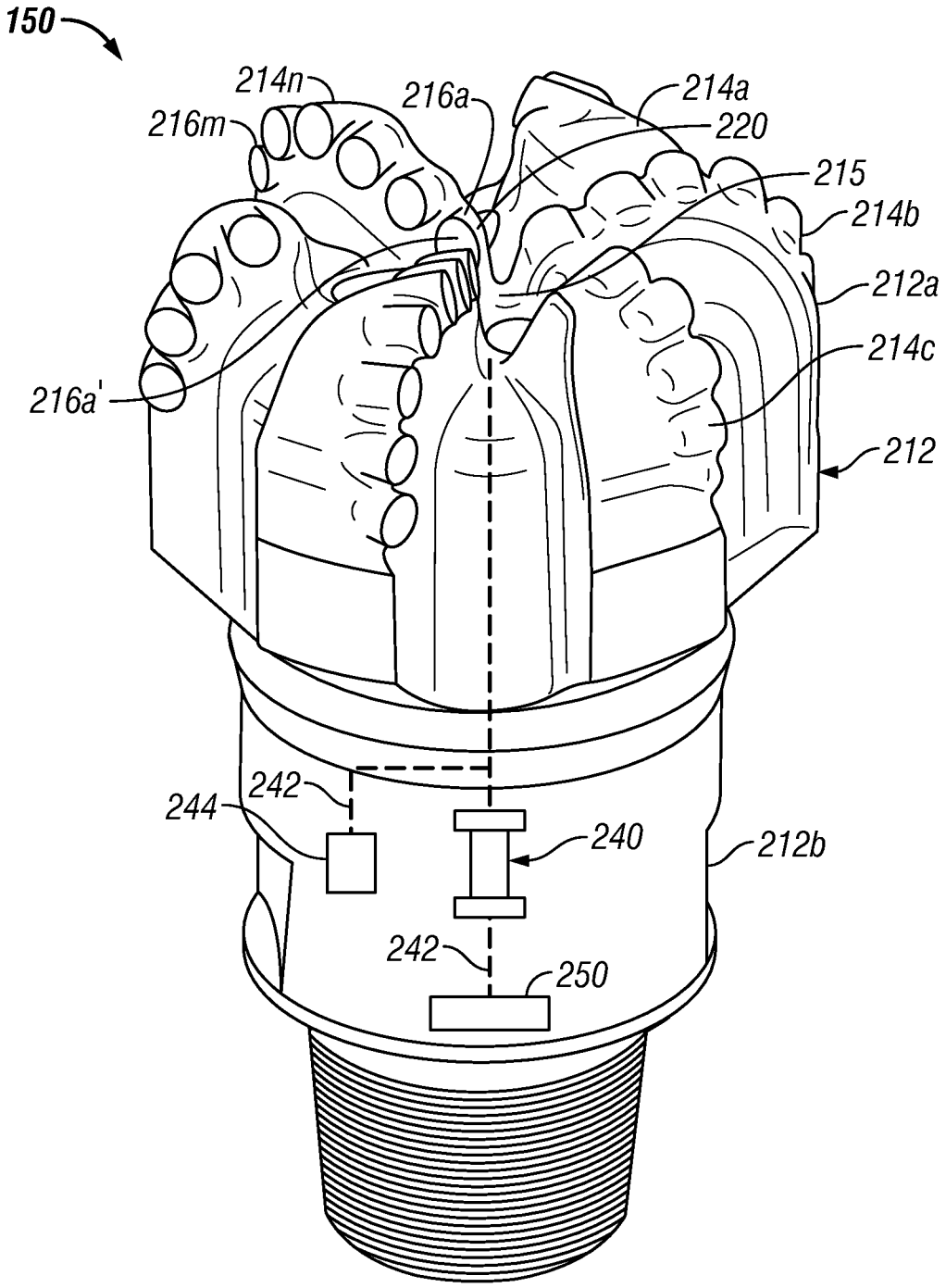
FIG. 2 is an isometric view of an exemplary drill bit incorporating a weight sensor and a torque sensor, according to one embodiment of the disclosure.

FIG. 2 shows an isometric view of an exemplary PDC drill bit 150 that includes a sensors and circuits made according to one embodiment of the disclosure. A PDC drill bit is shown for explanation purposes and not as a limitation. Any other type of drill bit may be utilized for the purpose of this disclosure. The drill bit 150 is shown to include a drill bit body 212 comprising a crown 212*a* and a shank 212*b*. The crown 212*a* includes a number of blades 214*a*, 214*b*, . . . 214*n*. A number of cutters are placed on each blade. For example, blade 214*a* is shown to contain cutters 216*a*-216*m*. All blades are shown to terminate at the bottom 215 of the drill bit. Each cutter has a cutting surface or cutting element, such as cutting element 216*a*' of cutter 216*a*, that engages the rock formation when the drill bit 150 is rotated during drilling of the wellbore. In one aspect, the drill bit 150 is shown to include a sensor package 240 that may house one or more suitable sensors, including, but not limited to, weight sensors, torque sensors and sensors for determining rotational speed, vibrations, oscillations, bending, stick-slip, whirl, etc. of the drill bit. Such sensors may be placed separately at suitable locations in the drill bit 150. For ease of explanation, and not as any limitation, weight and torque sensors are used to describe the various embodiments and methods herein. In one aspect, the weight sensor and the torque sensor may be disposed on a common sensor body. In another aspect, separate weight and torque sensors may be placed at suitable locations in the drill bit 150. Such sensors may be preloaded. In FIG. 2 a weight sensor 160*a* and a torque sensor 160*b* are shown placed proximate to each other in the sensor package 240 in the shank 212*b*. Such sensors also may be placed at any other suitable location in the drill body 212, including, but not limited to, the crown 212*a* and shank 212*b*. Other sensors 244 also are shown placed in the shank 212*b*. Conductors 242 may be used to transmit signals from the sensor package 240 and sensors 244 to a circuit 250 in the bit body, which circuit may be configured to process the sensor signals. The circuit 250, in one aspect, may be configured to amplify and digitize the signals from the weight and torque sensors. The circuit 250 may further include a processor configured to process sensor signals according to programmed instructions accessible to the processor. The sensor signals may be sent to the control unit 170 in the drilling assembly for processing. The circuit 250, controller 170 (FIG. 1) and controller 190 may communicate among each other via any suitable data communication method.

Figure 3:
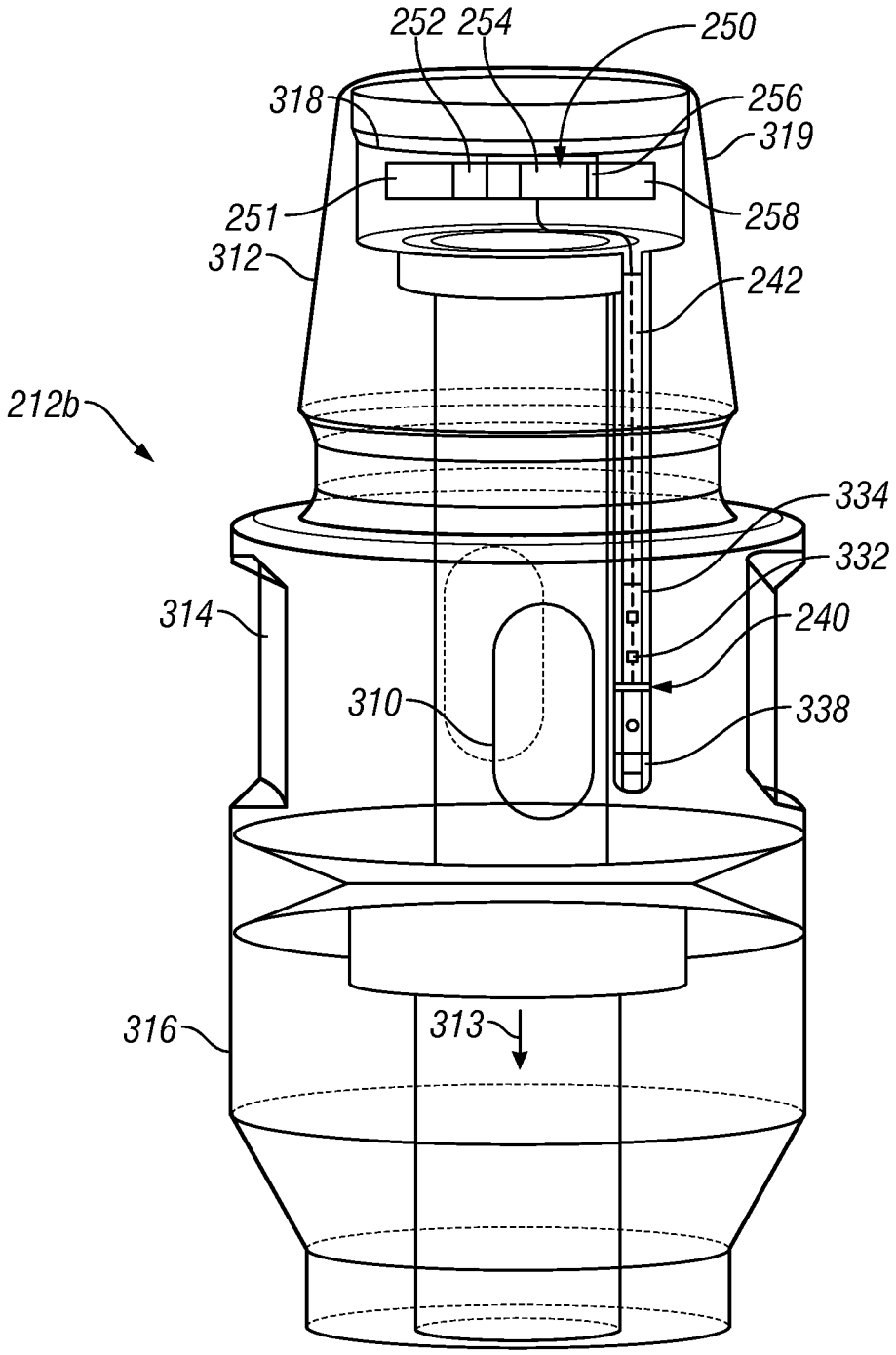
FIG. 3 is an isometric view showing placement of a weight sensor and a torque sensor in the drill bit and also placement of a circuit in the drill bit for processing signals from the weight sensor and torque sensor, according to one embodiment of the disclosure.

FIG. 3 shows certain details of the shank 212*b* according to one embodiment of the disclosure. The shank 212*b* includes a bore 310 therethrough for supplying drilling fluid 313 to the crown 212*a* of the drill bit 150 and one or more circular sections surrounding the bore 310, such as a neck section 312, a middle section 314 and a lower section 316. The upper end of the neck section 312 includes a recess 318. Threads 319 on the neck section 312 connect the drill bit 150 to the drilling assembly 130. In the particular configuration of FIG. 3, the sensor package 240 is shown placed in a cavity or recess 338 in section 314 of the shank 212*b*. Conductors 242 may be run from the sensors 332 and 334 to the electric circuit 250 in the recess 318. The circuit 250 may communicate signals with the downhole controller 170 (FIG. 1) via any suitable mechanism, including, but not limited to, conductors that run from the circuit 250 to the controller 170 (FIG. 1), slip rings on the drill bit and a connection on the drilling assembly 130 (FIG. 1), and an acoustic short-hop transmission method between the drill bit and the drilling assembly 130 (FIG. 1). In one aspect, the circuit 250 may include an amplifier 251 that amplifies the signals from the sensors 332 and 334 and an analog-to-digital (ND) converter 252 that digitizes the amplified signals. In another aspect, the sensor signals may be digitized without prior amplification. The circuit 250 may also include a processor 254 for processing signals provided by the ND converter, a data storage device 256 for storing data and programs 258 accessible to the processor 254. The sensor package 240 is shown to house both the weight sensors 332 and torque sensors 334. The weight and torque sensors may also be separately packaged and placed at any suitable location in the drill bit 150.

Figure 4:
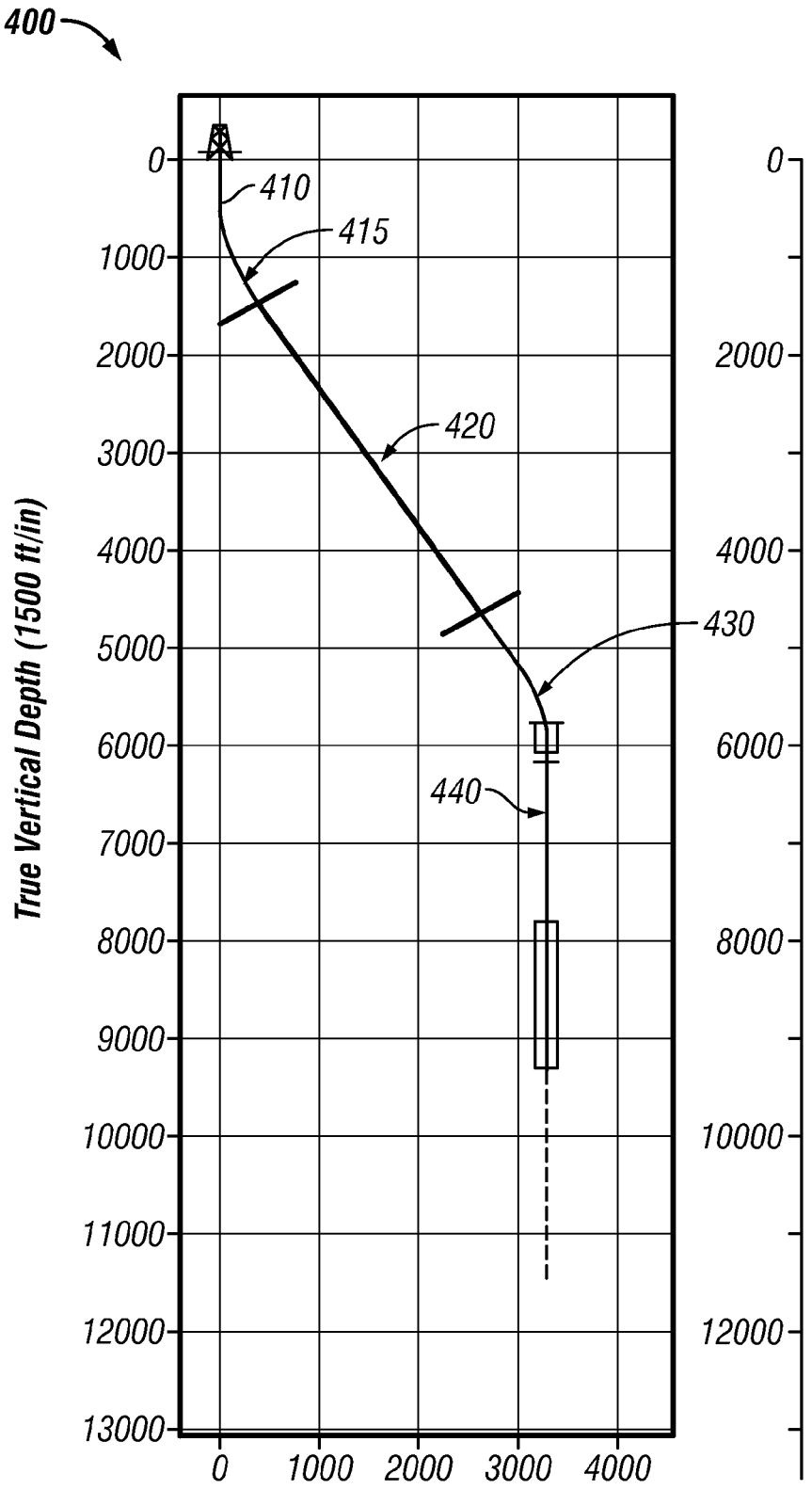
FIG. 4 shows an exemplary profile of a wellbore that includes vertical sections and an inclined section that may be more efficiently drilled using measurements made by weight and torque sensors in the drill bit.

FIG. 4 shows a wellbore profile 400 that includes a first or an upper vertical section 410 (from depth zero to about 500 ft.), an upper curved or a deviated section 415 (from depth about 500 ft to about 2300 ft), a straight deviated section 420 (from depth about 2300 ft. to about 4700 ft.), a lower curved or deviated section 430 (from depth about 4700 ft. to 6000 ft.) and a final vertical section 440 beyond depth 6000 ft. During drilling of a vertical section, such as section 410, weight-on-bit measured by a sensor in the drill bit is generally not significantly different from the weight-on-bit measured by sensors in the BHA or at the surface. Also, torque-on-bit and rate of penetration of the drill bit measured by sensors in the drill bit are generally about the same as torque-on-bit an RPM measured by sensors in the BHA. However, during drilling of a deviated or non-vertical section, such as sections 415 and 420, the weight-on-bit measured by a sensor in the drill bit can differ substantially from the weight-on-bit measured by a sensor in the BHA or at the surface. Also, torque-on-bit and rotational speed of the drill bit measured by sensors in the drill bit can differ substantially from torque-on-bit and rotational speed of the drill bit measured by sensors outside the drill bit. As noted previously, a driller and/or a controller in the system controls or alters the drilling operation by controlling drilling. For example the driller controls the weight applied on the drill bit from the surface, rotational speed of the drill bit by controlling rotation of the drill string and rotational speed of the drilling motor by controlling supply of the fluid from the surface. If the actual weight-on-bit (for example, that measured by a sensor in the drill bit) is greater than the measured weight-on-bit (for example, that measured by a sensor outside the drill bit), applying additional weight on the drill bit may cause the drill bit to break or wear or ball prematurely. However, if the actual weight-on-bit is less than the measured weight-on-bit then reducing the applied weight-on-bit can reduce rate of penetration and thus reduce the drilling efficiency. The same results will occur if the actual torque-on-bit (such as measured by a sensor in the drill bit) is different from the measured torque-on-bit by sensors outside the drill bit. A more accurate manner of drilling may be performed by utilizing the actual weight-on-bit and torque-on-bit obtained from bit-based sensors.

Figure 5:
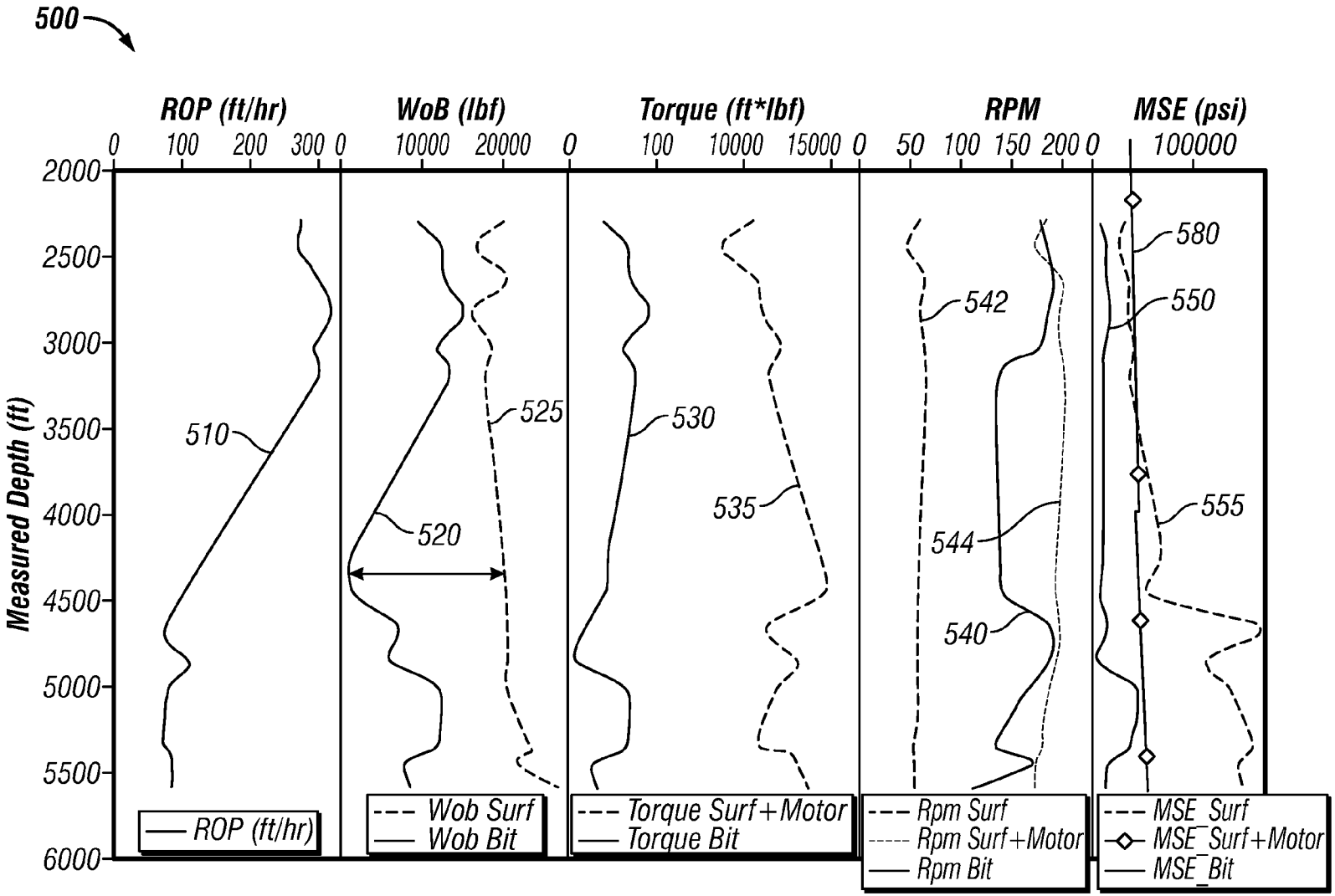
FIG. 5 shows comparison of various drilling parameters measured by bit-based sensors and sensors outside the drill bit during drilling of the deviated section of the wellbore shown in FIG. 4.

FIG. 5 shows logs of various drilling parameters measured by bit-based sensors and sensors outside the drill bit for the deviated section 420 shown in FIG. 4. The term "log" as used herein means values of a parameter plotted against the well depth. Log 510 shows rate of penetration (ROP) corresponding to the well depths from 2300 ft. to 5600 ft. The rate of penetration is generally the same whether measured by surface or downhole sensors. The weight-on-bit (WOB) measured by using a weight sensor in the drill bit is shown by log 520, while weight-on-bit measured by a surface sensor during drilling of the wellbore shown by log 525. Logs 520 and 525 show great variations in the measurements of weigh-on-bit during drilling. The torque-on-bit measured by a torque sensor in the drill bit and sensors outside the drill bit (surface and drilling motor) are respectively shown by logs 530 and 535. The rotational speed of the drill bit (RPM) measured by the sensor in the dill bit is shown by log 540, while rotational speed of the drill bit measured by a sensor at the surface is shown by log 542 and the combined rotational speed of the drill bit measured by a surface sensor (relating to rotation of the drill string) and a sensor that measures rotation of a drilling motor coupled to the drill bit is shown by log 544. Log 550 shows the mechanical-specific-energy (MSE) of the drilling assembly calculated using weight-on-bit and torque-on-bit measurements made by bit-based sensors while log 555 shows mechanical specific energy of the drilling assembly calculated using weight-on-bit and torque-on-bit measurements made by sensors outside the drill bit. The mechanical-specific-energy shown in FIG. 5 is computed as follows.

$$MSE=(k_1\times TOB\times RPM)/ROP\times D^2)+(k_2\times WOB/\pi\times D^2)$$

where, $k_1$ and $k_2$ are constants, ToB is the torque-on-bit determined using a sensor on the bit, ROP is the obtained rate of penetration of the drill bit, D is the drill bit diameter and WoB is weight-on-bit determined using measurement from a sensor in the drill bit. In the specific example shown in FIG. 5, the mechanical-specific-energy 550 calculated using bit-based weight and torque sensors is consistently less than the mechanical specific energy 555 calculated using weight and torque sensors outside the drill bit. Line 580 shows an exemplary desired mechanical-specific-energy for efficient drilling of section 420 shown in FIG. 4. If the driller is provided with the real time mechanical specific energy values computed using bit-based weight and torque sensors (log 550), the driller would tend to alter one or more drilling parameters (such as weight-on-bit) so as to increase rate of penetration, which will increase the mechanical-specific-energy until the mechanical specific energy is close to the desired mechanical-specific-energy shown in log 580. Rate of penetration is a parameter commonly used to determine drilling efficiency. In general, a higher rate of penetration without prematurely degrading the drill bit or the drilling assembly corresponds to higher drilling efficiency. If, on the other hand, the driller is provided with real time computed mechanical specific energy shown in log 555, the driller would reduce one or more drilling parameters, such as weight-on-bit, to reduce the mechanical specific energy to a value close to the value specified in log 580, which will reduce rate of penetration and thus reducing the drilling efficiency. In this particular example, the driller would be reducing drilling efficiency even though the actual values of the mechanical specific energy are less than the desired values. In the case in which the mechanical specific energy calculated using bit-based sensors is higher than the mechanical specific energy calculated using sensors outside the bit, the driller may increase the weight-on-bit and/or rotational speed of the drill bit, thereby increasing rate of penetration but could wear the drill bit prematurely, break the drill bit and/or damage the BHA.

Thus, in one aspect, the disclosure provides a method of drilling a wellbore, comprising: drilling the wellbore using a bottomhole assembly having a drill bit attached to a bottom hole assembly, the drill bit including a weight sensor and a torque sensor; determining weight-on-bit using measurements from the weight sensor and torque-on-bit using measurements from the torque sensor during drilling of the wellbore; obtaining measurements for rotational speed of the drill bit and rate of penetration of the drill bit into the formation per unit time during drilling of the wellbore; determining mechanical specific energy of the drilling assembly using the measured weight-on-bit, measured torque-on-bit, obtained measurements of the rotational speed of the drill bit and the obtained rate of penetration of the drill bit; and altering a drilling a parameter based on the determined mechanical specific energy. The step of altering a drilling parameter may include altering one of weight applied on drill bit from the surface and/or rotational speed of the drill bit. The drill bit may be rotated by rotating the drill string, rotating a motor in the bottomhole assembly coupled to the drill bit or rotating the drill string and a motor. In one aspect, the mechanical specific energy may be calculated by: $MSE=(k_1\times TOB\times RPM)/ROP\times D^2)+(k_2\times WOB/\pi\times D^2)$, where, $k_1$ and $k_2$ are constants, TOB is the torque-on-bit determined using a sensor on the bit, ROP is the obtained rate of penetration of the drill bit, D is the drill bit diameter and WoB is weight-on-bit determined using measurement from a sensor in the drill bit. In aspects, MSE is determined in real time or near real time.

In another aspect, the disclosure provides an apparatus for drilling a wellbore. One embodiment of the apparatus includes: a bottom hole assembly having a drill bit attached thereto that includes a weight sensor and a torque sensor; and a processor configured to determine weight-on-bit using measurements form the weight sensor and to determine torque-on-bit using measurements from the torque sensor during drilling of the wellbore, obtain measurements for rotational speed of the drill bit and rate of penetration of the drill bit during drilling of the wellbore, and determine a mechanical specific energy of the bottomhole assembly using the determined weight-on-bit, torque-on-bit, obtained rotational speed of the drill bit and the obtained rate of penetration of the drill bit. In one aspect, the processor is further configured to cause a change of a drilling parameter based on the determined mechanical specific energy during drilling of the wellbore. In another aspect, the processor determines mechanical specific energy using the relationship: $MSE=(k_1\times TOB\times RPM)/ROP\times D^2)+(k_2\times WOB/\pi\times D^2)$ where, $k_1$ and $k_2$ are constants, ToB is the torque-on-bit determined using a sensor on the bit, ROP is the obtained rate of penetration of the drill bit, D is the drill bit diameter and WoB is weight-on-bit determined using measurement from a sensor in the drill bit. In aspects, MSE is determined in real time or near real time. In another aspect, the drilling parameter altered is the weight applied on the drill bit from the surface and/or the rotational speed of the drill bit. The apparatus may further include conveying member attached to the bottomhole assembly for conveying the bottomhole assembly in the wellbore for drilling the wellbore. The apparatus may further include a surface controller configured to control an operation of the bottomhole assembly during drilling of the wellbore in response to the determined MSE. In another aspect, the bottomhole assembly may further include sensors configured to determine one or more of vibration, whirl and stick-slip and the processor is further configured to alter a drilling parameter based on one or more of such parameters.

The foregoing description is directed to certain embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

The invention claimed is:

1. A method of drilling a wellbore, comprising:

drilling the wellbore using a drill string having a drill bit attached to a bottom hole assembly therein, the drill bit including a weight sensor and a torque sensor;

measuring weight-on-bit using the weight sensor and torque-on-bit using the torque sensor during drilling of the wellbore;

obtaining measurements for rotational speed of the drill bit using a sensor at the drill bit during drilling of the wellbore;

obtaining measurements of rate of penetration of the drill bit during drilling of the wellbore; determining a mechanical specific energy of the bottomhole assembly using the measured weight-on-bit, measured torque-on-bit, obtained rotational speed of the drill bit and the obtained rate of penetration of the drill bit, wherein the mechanical specific energy is determined by $$MSE=(k_1\times TOB\times RPM)/ROP\times D^2)+(k_2\times WOB/\pi\times D^2)$$

where, $k_1$ and $k_2$ are constants, ToB is the measured torque-on-bit, ROP is the obtained rate of penetration of the drill bit, D is the drill bit diameter an WoB is the measured weight-on-bit;

determining whirl of the drill bit; and altering a drilling a parameter based on the determined mechanical specific energy and the whirl of the drill bit.

2. The method of claim 1, wherein altering a drilling parameter comprises altering one of: weight on the drill bit applied from the surface; and the rotational speed of the drill bit.

3. The method of claim 1 further comprising rotating the drill during drilling by one of: (i) rotating the drill string; (ii) rotating a motor in the bottomhole assembly coupled to the drill bit; and (iii) rotating the drill string and a motor in the bottom hole assembly coupled to the drill bit.

4. The method of claim 1 further comprising measuring vibration of the bottom hole assembly or the drill bit and altering the drilling parameter based at least in part on the measured vibration.

5. The method of claim 1 further comprising determining at stick, and altering the drilling parameter based on MSE, whirl and stick.

6. The method of claim 1, wherein determining the mechanical specific energy further comprises determining the mechanical specific energy during drilling of a non-vertical section of the wellbore.

7. The method of claim 1 further comprising determining the mechanical specific energy in real time using a processor located at one of: (i) the bottom hole assembly; and (ii) the surface.

8. An apparatus for drilling a wellbore, comprising:

a bottom hole assembly including a drill bit attached thereto, the drill bit including a weight sensor and a torque sensor, a rotational speed sensor, and a sensor for measuring whirl of the drill bit;

a processor configured to:

determine weight-on-bit using the weight sensor and torque-on-bit using the torque sensor during drilling of the wellbore;

obtain measurements for rotational speed of the drill bit using the rotational speed sensor during drilling of the wellbore;

obtain measurements of rate of penetration of the drill bit during drilling of the wellbore;

determine a mechanical specific energy of the BHA using the measured weight-on-bit, measured torque-on-bit, obtained measurements of the rotational speed of the drill bit and the obtained rate of penetration of the drill bit, altering a drilling a parameter based on the determined mechanical specific energy, wherein the mechanical specific energy is determined by $$MSE=(k_1\times TOB\times RPM)/ROP\times D^2)+(k_2\times WOB/\pi\times D^2)$$

where, $k_1$ and $k_2$ are constants, ToB is the measured torque-on-bit, ROP is the obtained rate of penetration of the drill bit, D is the drill bit diameter an WoB is the measured weight-on-bit;

determine whirl of the drill bit; and alter a drilling a parameter based on the determined mechanical specific energy and the whirl of the drill bit.

9. The apparatus of claim 8, wherein the processor is further configured to cause altering of a drilling a parameter based on the determined mechanical specific energy during drilling of the wellbore.

10. The method of claim 8, wherein the drilling parameter comprises one of: weight on the drill bit applied from the surface; and the rotational speed of the drill bit.

11. The method claim 1 further comprising a conveying member attached to the bottomhole assembly for conveying the bottomhole assembly in the wellbore for drilling the wellbore.

12. The apparatus of claim 11 further comprising a surface controller configured to control an operation of the bottomhole assembly during drilling of the wellbore.

13. The apparatus of claim 8 further comprising a motor in the bottomhole assembly coupled to the drill bit configured to rotate the drill bit during drilling of the wellbore.

14. The apparatus of claim 8, wherein the processor is further configured to determine vibration of one of bottomhole assembly and the drill bit from a vibration sensor and alter the drilling parameter based at least in part on the determined vibration.

15. The apparatus of claim 8, wherein the processor is further configured to determine stick-slip from a sensor in the drill bit and to alter the drilling parameter based on the determined MSE, whirl and stick-slip.

16. The apparatus of claim 8, wherein the processor is further configured to determine the mechanical specific energy during drilling of a non-vertical section of the wellbore.

17. The apparatus of claim 8 further comprising a controller at the surface and wherein the mechanical specific energy in determined in real time by one of: (i) the processor; (ii) the surface controller; and (iii) a combination of the processor and the surface controller.

18. The apparatus of claim 8 further comprising a drilling tubular connected to the bottomhole assembly and wherein the drilling tubular extends to a surface location and a controller at the surface that includes the processor.

* * * * *